US011781552B2

(12) United States Patent
Watanabe

(10) Patent No.: US 11,781,552 B2
(45) Date of Patent: Oct. 10, 2023

(54) VACUUM PUMP SYSTEM AND VACUUM PUMP

(71) Applicant: SHIMADZU CORPORATION, Kyoto (JP)

(72) Inventor: Kota Watanabe, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 17/678,198

(22) Filed: Feb. 23, 2022

(65) Prior Publication Data

US 2022/0364568 A1 Nov. 17, 2022

(30) Foreign Application Priority Data

May 17, 2021 (JP) ..... 2021-083183

(51) Int. Cl.
*F04D 19/04* (2006.01)
*F04D 29/58* (2006.01)
*F04D 25/16* (2006.01)

(52) U.S. Cl.
CPC ..... *F04D 19/04* (2013.01); *F04D 25/16* (2013.01); *F04D 29/582* (2013.01)

(58) Field of Classification Search
CPC ..... F04D 19/04; F04D 19/042; F04D 19/044; F04D 19/046; F04D 25/16; F04D 29/582; F04D 29/584; C23C 16/4401; C23C 16/4405; C23C 16/4407; C23C 16/4408; C23C 16/4412; H01J 29/84
See application file for complete search history.

(56) References Cited

U.S. PATENT DOCUMENTS 5,879,139 A * 3/1999 Hayashi ..... F04C 29/0092 415/176
2015/0260174 A1* 9/2015 Furuta ..... F04D 17/168 417/205

FOREIGN PATENT DOCUMENTS

JP 2006074362 A 3/2006
JP 2020090922 A 6/2020
JP 2020112133 A 7/2020

OTHER PUBLICATIONS

Trappack Product literature, Gas Powder Removal Device, Taisei Giken Co., Ltd, downloaded from http://www.taiseigiken.com/products/trappack/index.html on Feb. 23, 2022.

* cited by examiner

*Primary Examiner* — Brian O Peters
(74) *Attorney, Agent, or Firm* — Renner, Otto, Boisselle & Sklar, LLP

(57) ABSTRACT

A vacuum pump system includes a first vacuum pump and a second vacuum pump connected to an exhaust port of the first vacuum pump. The second vacuum pump has a pump portion and a trap portion. The pump portion has a rotor. The trap portion is configured such that a reaction product generated from gas guided to an internal space from the exhaust port of the first vacuum pump by suction by the pump portion is accumulated thereon.

8 Claims, 4 Drawing Sheets

VACUUM PUMP SYSTEM AND VACUUM PUMP

BACKGROUND OF THE INVENTION

1. Technical Field

The present invention relates to a vacuum pump system and a vacuum pump.

2. Background Art

Vacuum pumps include one including a turbine blade pump portion having stator blades and rotor blades and a drag pump portion provided on an exhaust downstream side with respect to the turbine blade pump portion. A vacuum pump system including such a vacuum pump is, for example, used for the technique of bringing the inside of a process chamber, in which a process such as dry etching or chemical vapor deposition (CVD) is executed, into a high vacuum.

In the case of using the vacuum pump system for bringing the inside of the process chamber into a high vacuum, there is a probability that a reaction product is generated and accumulated in the vacuum pump included in the vacuum pump system, devices (e.g., a dry pump) other than the vacuum pump, and/or a gas pipe. Generation of the reaction product in the vacuum pump system needs to be reduced. This is because there is a probability that when the reaction product is accumulated in the vacuum pump, a component (e.g., a rotor) of the vacuum pump and the reaction product contact each other, and because when the reaction product is accumulated in the other devices and the gas pipe, the exhaust capacity of the vacuum pump system is degraded.

As the method for reducing generation of the reaction product in the vacuum pump, a method in which the internal temperature of a vacuum pump is increased has been known. For example, in Patent Literature 1 (JP-A-2020-112133), a body of a vacuum pump is heated by a heater such that the internal temperature thereof is increased. Moreover, in Patent Literature 2 (JP-A-2020-90922), high-temperature purge gas is injected into a vacuum pump to increase the internal temperature thereof. For reducing accumulation of a reaction product in a gas pipe and a device connected to an exhaust side of a vacuum pump, a filter is provided on the exhaust side of the vacuum pump in Patent Literature 3 (JP-A-2006-74362).

However, an increase in the internal temperature of the vacuum pump is preferably suppressed. This is because as the internal temperature of the vacuum pump increases, the rotor expands due to an increase in the temperature thereof and is likely to contact other components. As a result, the life of the vacuum pump determined by time until contact with the other components due to expansion of the rotor is shortened.

SUMMARY OF THE INVENTION

In the case of increasing the internal temperature of the vacuum pump by the methods of Patent Literatures 1 and 2, the exhaust flow rate of the vacuum pump cannot be increased for suppressing a further temperature increase. Specifically, the exhaust flow rate of the vacuum pump needs to be decreased such that a load on a motor configured to rotate the rotor is reduced and heat generation from the motor is reduced.

Further, in the case of providing the filter on the exhaust side of the vacuum pump as in Patent Literature 3, the flow of gas on the exhaust side of the vacuum pump gets worse as the reaction product is more accumulated on the filter. As the flow of gas on the exhaust side of the vacuum pump gets worse, the exhaust-side pressure (the back pressure) of the vacuum pump increases. As a result, the exhaust performance of the vacuum pump is degraded, and/or the motor load increases. This leads to greater heat generation.

An object of the present invention is to maintain exhaust performance while reducing generation of a reaction product in a vacuum pump in a vacuum pump system.

A vacuum pump system according to one aspect of the present invention includes a first vacuum pump and a second vacuum pump. The second vacuum pump is connected to an exhaust port of the first vacuum pump. The second vacuum pump has a pump portion and a trap portion. The pump portion has a rotor. The trap portion is configured such that a reaction product generated from gas guided to an internal space from the exhaust port of the first vacuum pump by suction by the pump portion is accumulated thereon.

In the above-described vacuum pump system according to one aspect of the present invention, the pump portion of the second vacuum pump guides, by sucking, gas into the internal space of the trap portion of the second vacuum pump from the exhaust port of the first vacuum pump. With this configuration, the pressure of an exhaust path from the inside of the first vacuum pump to the second vacuum pump can be decreased, and therefore, generation of the reaction product in the first vacuum pump and the exhaust path from the first vacuum pump to the second vacuum pump is reduced. As a result, the frequency of maintenance of the first vacuum pump and a gas pipe can be decreased. Moreover, the reaction product is accumulated in the internal space of the trap portion of the second vacuum pump, and therefore, generation of the reaction product in the pump portion can be reduced.

Since generation of the reaction product in the exhaust path from the first vacuum pump to the second vacuum pump is reduced, the conductance of such an exhaust path is maintained high. As a result, the capacity of the pump portion for sucking gas from the exhaust port of the first vacuum pump is not degraded, and therefore, the exhaust-side pressure (the back pressure) of the first vacuum pump can be maintained low. Further, it is not necessary to increase the internal temperature of the first vacuum pump for reducing generation of the reaction product. As a result, the exhaust performance of the vacuum pump system can be maintained high. Further, the exhaust capacity of the first vacuum pump is improved.

DETAILED DESCRIPTION OF THE EXEMPLARY EMBODIMENTS

1. Configuration of Vacuum Pump System

Figure 1:
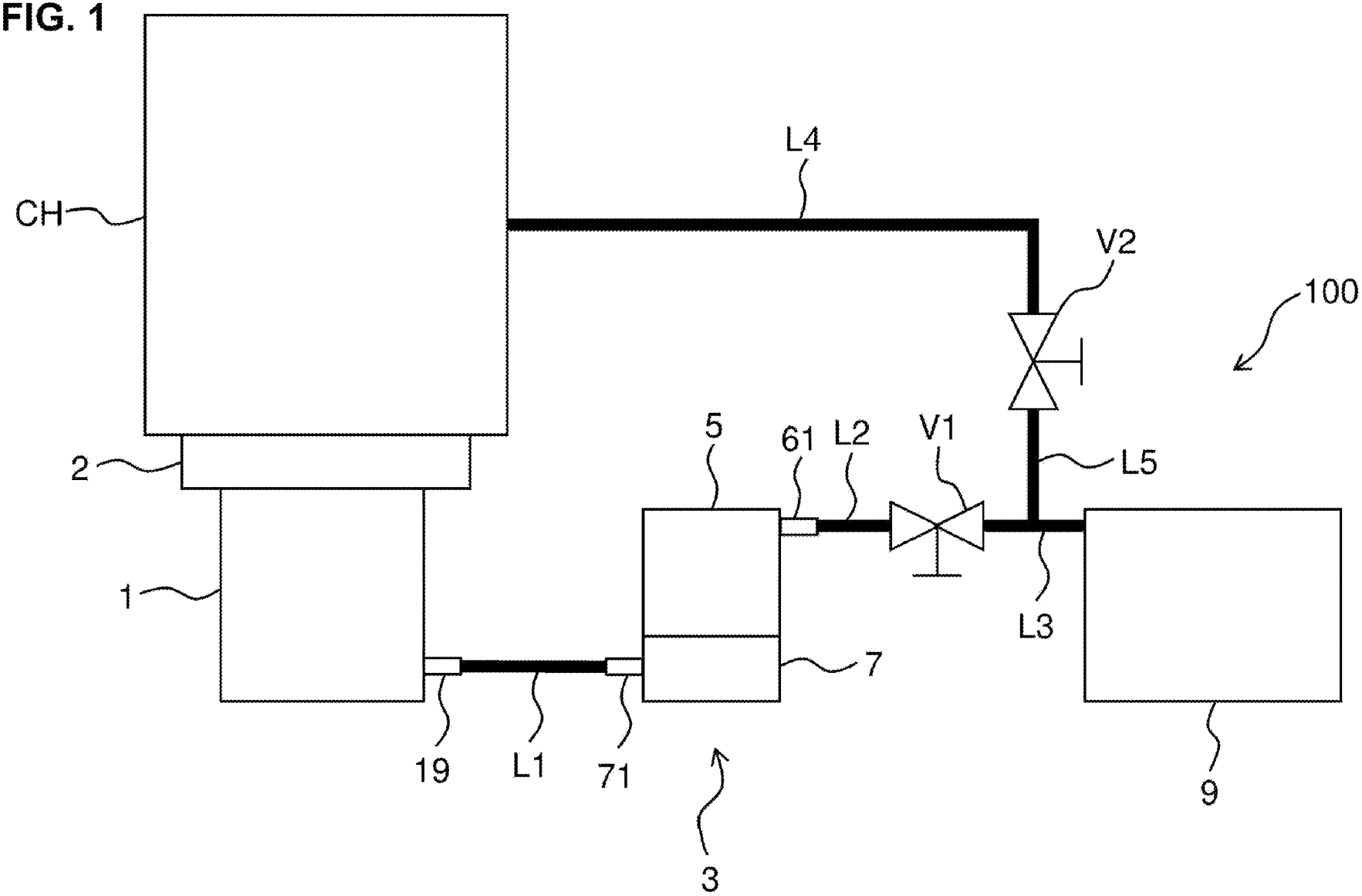
FIG. 1 is a view showing the configuration of a vacuum pump system according to an embodiment.

Hereinafter, the configuration of a vacuum pump system according to one embodiment will be described with reference to the drawings. FIG. 1 is a view showing the configuration of a vacuum pump system 100 according to the embodiment. The vacuum pump system 100 is a system configured to discharge gas from a gas-discharging target device CH. The gas-discharging target device CH is, for example, a process chamber of a semiconductor manufacturing device. The vacuum pump system 100 includes a first vacuum pump 1, a second vacuum pump 3, and a third vacuum pump 9.

A suction side of the first vacuum pump 1 is connected to the inside of the gas-discharging target device CH through an on-off valve 2. The on-off valve 2 switches, by opening/closing of the valve, the suction side of the first vacuum pump 1 and the inside of the gas-discharging target device CH between a communication state and a disconnection state. Moreover, the on-off valve 2 is a vacuum valve configured to control the opening degree of the valve to control the internal pressure of the gas-discharging target device CH. An exhaust side of the first vacuum pump 1 is connected to the second vacuum pump 3 through a first gas line L1.

The second vacuum pump 3 has a pump portion 5 and a trap portion 7. A suction side of the pump portion 5 is connected to the trap portion 7. The trap portion 7 is connected to the exhaust side of the first vacuum pump 1 through the first gas line L1. An exhaust side of the pump portion 5 is connected to a suction side of the third vacuum pump 9 through a second gas line L2, a first valve V1, and a third gas line L3. The third vacuum pump 9 is, for example, a dry pump. Moreover, the suction side of the third vacuum pump 9 is connected to the inside of the gas-discharging target device CH through a fourth gas line L4, a second valve V2, a fifth gas line L5, and the third gas line L3.

2. Configuration of First Vacuum Pump

Figure 2:
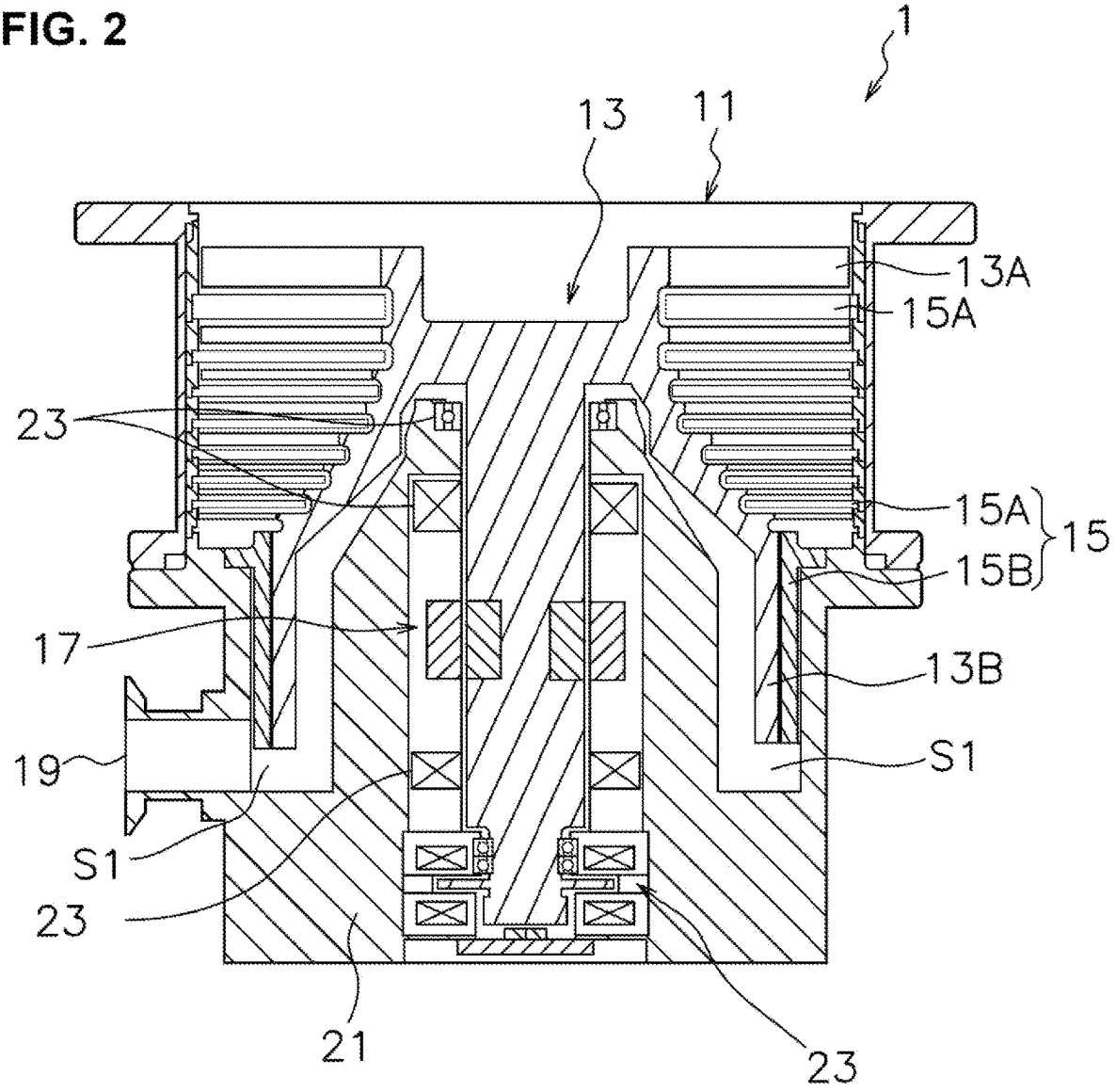
FIG. 2 is a sectional view of a first vacuum pump.

Hereinafter, a specific configuration of the first vacuum pump 1 will be described with reference to FIG. 2. FIG. 2 is a sectional view of the first vacuum pump 1. The first vacuum pump 1 includes a first suction port 11, a first rotor 13, a first stator 15, a first motor 17, and a first exhaust port 19. The first suction port 11 is on the suction side of the first vacuum pump 1, and is connected to the inside of the gas-discharging target device CH through the on-off valve 2.

The first rotor 13 includes multiple stages of rotor blades 13A and a rotor cylindrical portion 13B. The first rotor 13 is rotatably supported by a first base 21 and a first bearing 23. The first rotor 13 is rotated by the first motor 17. The first stator 15 includes multiple stages of stator blades 15A and a stator cylindrical portion 15B. A screw groove is formed at an inner peripheral surface (a surface facing the rotor cylindrical portion 13B) of the stator cylindrical portion 15B. In the first vacuum pump 1, the rotor blades 13A and the stator blades 15A are alternately arranged, thereby forming a turbo-molecular pump portion. On the other hand, the rotor cylindrical portion 13B and the stator cylindrical portion 15B are, at a lower portion of the turbo-molecular pump portion, arranged facing each other with a slight clearance, thereby forming a screw groove pump portion. The first exhaust port 19 communicates with a first internal space S1 at a lower portion of the screw groove pump portion. The first exhaust port 19 is connected to the second vacuum pump 3 through the first gas line L1.

In the first vacuum pump 1, the turbo-molecular pump portion and the screw groove pump portion suck gas from the gas-discharging target device CH into the first suction port 11 by rotation of the first rotor 13 by the first motor 17. The turbo-molecular pump portion and the screw groove pump portion guide the gas sucked through the first suction port 11 to the first internal space S1, and discharge the gas through the first exhaust port 19. As a result, the inside of the gas-discharging target device CH is brought into a high vacuum state. The gas discharged through the first exhaust port 19 is sucked by the second vacuum pump 3.

3. Configuration of Second Vacuum Pump

Figure 3:
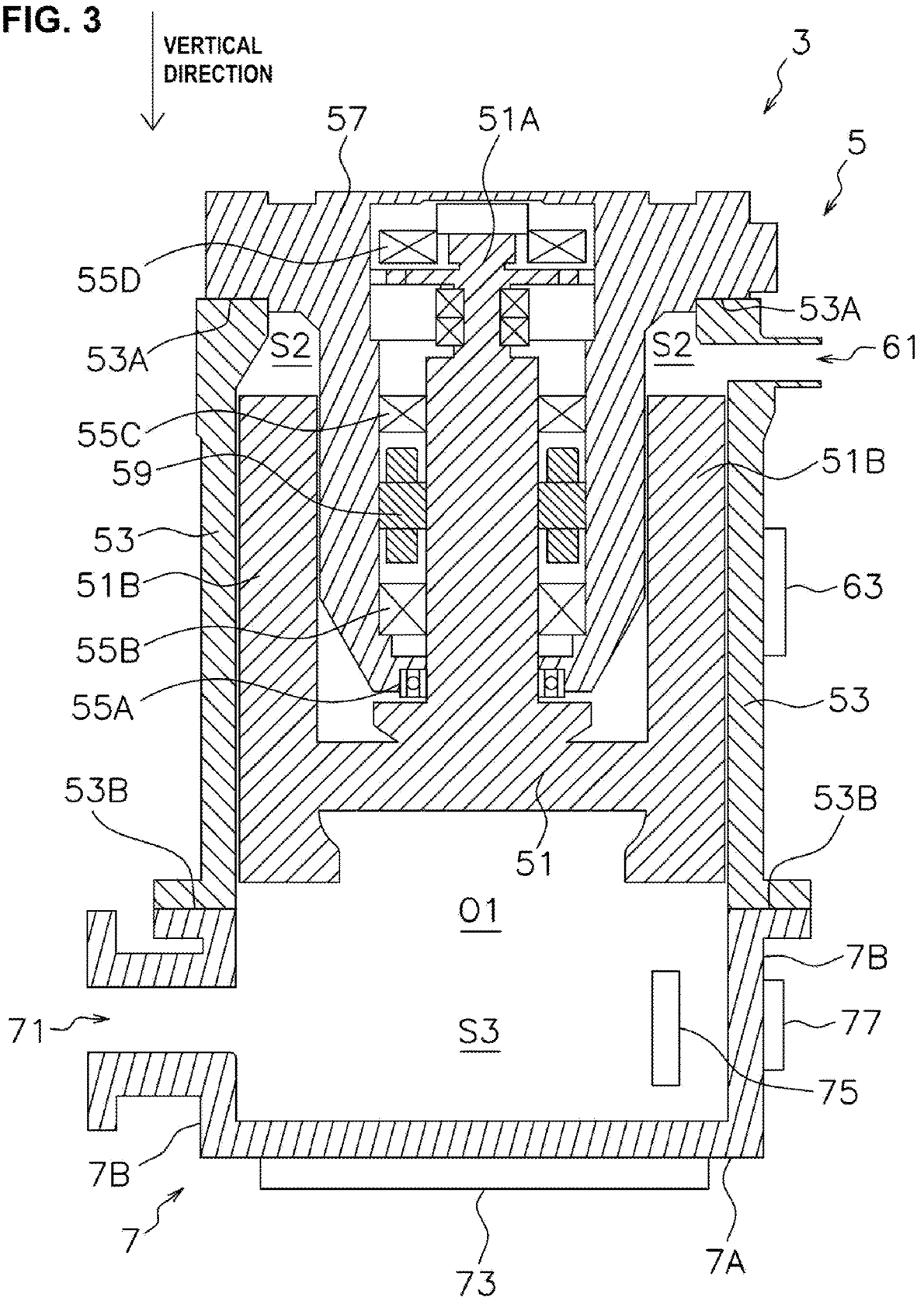
FIG. 3 is a sectional view of a second vacuum pump.

Next, the configuration of the second vacuum pump 3 will be described with reference to FIG. 3. FIG. 3 is a sectional view of the second vacuum pump 3. Note that an arrow in FIG. 3 indicates the vertical direction. As described above, the second vacuum pump 3 includes the pump portion 5 and the trap portion 7. The pump portion 5 includes a second rotor 51 and a second stator 53.

The second rotor 51 has a shaft 51A. The shaft 51A is rotatably supported by multiple second bearings 55A to 55D. The multiple second bearings 55A to 55D are attached to the position of a second base 57 in which the shaft 51A is housed. The second bearing 55A is, for example, a ball bearing. On the other hand, the other second bearings 55B to 55D are, for example, magnetic bearings. Note that the multiple second bearings 55B to 55D may be other types of bearings such as a ball bearing. A second motor 59 is further attached to the position of the second base 57 in which the shaft 51A is housed. The second motor 59 rotates the second rotor 51. A second rotor cylindrical portion 51B is formed at an outer peripheral portion of the second rotor 51. The second rotor cylindrical portion 51B extends in an axial direction in which the shaft 51A extends.

The second stator 53 equivalent to a case is a tubular member having a first end 53A and a second end 53B. The first end 53A is connected to the second base 57. The second end 53B forms an opening O1. The second stator 53 houses the second rotor 51 in a state in which a slight clearance is formed between an outer peripheral surface of the second rotor cylindrical portion 51B and an inner peripheral surface of the second stator 53. A screw groove is formed at the inner peripheral surface of the second stator 53, i.e., a surface facing the second rotor cylindrical portion 51B. Since the slight clearance is formed between the outer peripheral surface of the second rotor cylindrical portion 51B and the inner peripheral surface of the second stator 53 and the screw groove is formed at the inner peripheral surface of the second stator 53, the second rotor cylindrical portion 51B and the second stator 53 form a Holweck pump portion. The Holweck pump portion is connected to a second internal space S2. The second internal space S2 is a space surrounded by an upper end portion of the second rotor cylindrical portion 51B, a first end 53A side of the second stator 53, and the second base 57.

Note that in the above-described Holweck pump portion, the screw groove is not necessarily provided at the inner peripheral surface of the second stator 53 and may be provided at the outer peripheral surface of the second rotor cylindrical portion 51B facing the second stator 53.

A second exhaust port 61 is provided at an upper portion of the second stator 53. The second exhaust port 61 is connected to the second internal space S2. The second exhaust port 61 is on an exhaust side of the second vacuum pump 3, and is connected to the suction side of the third vacuum pump 9 through the second gas line L2, the first valve V1, and the third gas line L3.

A first heater 63 is provided at an outer peripheral surface of the second stator 53. The first heater 63 heats the pump portion 5. The pump portion 5 is heated by the first heater 63 so that generation of a reaction product at the pump portion 5 can be reduced. The temperature of heating of the pump portion 5 by the first heater 63 is, for example, 150° C. Such a heating temperature can be set as necessary according to, e.g., a raw material used for a process performed in the gas-discharging target device CH.

In the pump portion 5, the second rotor 51 is rotated by the second motor 59, and accordingly, the Holweck pump portion sucks gas into the opening O1. The Holweck pump portion guides the sucked gas to the second internal space S2, and then, discharges the gas through the second exhaust port 61. The gas discharged through the second exhaust port 61 is sucked by the third vacuum pump 9.

The trap portion 7 has a bottom portion 7A and a side portion 7B. One end of the side portion 7B is connected to the bottom portion 7A. The bottom portion 7A and the side portion 7B form a third internal space S3. The trap portion 7 has, for example, such a cylindrical shape that the bottom portion 7A is in a circular shape. Since the trap portion 7 is in the cylindrical shape, gas is easily accumulated in the third internal space S3. Note that the trap portion 7 may be in other shapes (e.g., a rectangular parallelepiped shape or a solid with a polygonal bottom portion 7A) other than the cylindrical shape as long as gas can be held inside for a certain degree of time.

Alternatively, other gas accumulation structures may be provided in the third internal space S3 of the trap portion 7. For example, a wall is provided in the third internal space S3 to form, in the third internal space S3, a location where gas is less likely to flow. For example, a gas accumulation structure such as a louver-shaped or spiral fin may be provided on the bottom portion 7A.

The other end of the side portion 7B is connected to the second end 53B of the second stator 53. Note that the side portion 7B may be fixed to the second stator 53 by, e.g., welding or may be connected to the second stator 53 with, e.g., a screw so as to be detachable from the second stator 53. In the case of detachably connecting the side portion 7B to the second stator 53, the side portion 7B and the second stator 53 are gas-tightly connected to each other by a method in which a gas seal is provided between the side portion 7B and the second stator 53, for example.

The side of the third internal space S3 opposite to the bottom portion 7A opens, and is connected to the opening O1. A second suction port 71 is provided at an optional portion of the side portion 7B. The second suction port 71 is connected to the third internal space S3. The second suction port 71 is connected to the first exhaust port 19 of the first vacuum pump 1 through the first gas line L1. With this configuration, the opening O1 of the pump portion 5 is connected to the third internal space S3, the second suction port 71, the first gas line L1, and the first exhaust port 19 of the first vacuum pump 1 so that gas can flow therein. Thus, the pump portion 5 can guide gas, which has been discharged from the first vacuum pump 1 through the first exhaust port 19, to the third internal space S3 through the first gas line L1.

The trap portion 7 is, for example, a member made of metal such as aluminum or stainless steel. The trap portion 7 may be formed in such a manner that a single metal plate is bent, or may be formed in such a manner that the bottom portion 7A and the side portion 7B formed as separate members are connected to each other by, e.g., welding, for example.

As shown in FIG. 3, the pump portion 5 is arranged so that the opening O1 is on the lower side in the vertical direction. Moreover, the trap portion 7 is arranged further on the lower side in the vertical direction with respect to the opening O1. That is, the trap portion 7 is arranged on the lower side in the vertical direction with respect to the pump portion 5. With this configuration, the reaction products accumulated on the bottom portion 7A and the side portion 7B of the trap portion 7 stay on the trap portion 7 due to the force of gravity, and are less likely to enter the pump portion 5.

The second vacuum pump 3 includes a cooling portion 73. The cooling portion 73 is attached in contact with the bottom portion 7A of the trap portion 7. Note that the cooling portion 73 may be attached to the side portion 7B of the trap portion 7. The cooling portion 73 is, for example, a metal pipe in which a coolant can flow therein. The cooling portion 73 cools the bottom portion 7A and the side portion 7B of the trap portion 7. The bottom portion 7A and the side portion 7B are cooled so that gas in the third internal space S3 can be cooled. The gas in the third internal space S3 is cooled so that generation of the reaction product in the third internal space S3 can be accelerated. This is because in a case where gas injected into the gas-discharging target device CH, i.e., gas discharged by the vacuum pump system 100, is used as the raw material to generate the reaction product, the reaction product is more easily generated as the temperature of the gas decreases.

The second vacuum pump 3 includes a plasma generation portion 75. The plasma generation portion 75 is provided in the third internal space S3 of the trap portion 7. The plasma generation portion 75 generates plasma in the third internal space S3. The plasma generated from the plasma generation portion 75 decomposes the reaction product accumulated in the third internal space S3 and the like. For example, the plasma is generated from the plasma generation portion 75 upon maintenance so that cleaning (removal of the reaction product) of the trap portion 7 and the like can be executed. The plasma generation portion 75 is, for example, a parallel plate plasma generation device or an inductively coupled plasma (ICP) generation device.

The second vacuum pump 3 includes a second heater 77. The second heater 77 is provided on the side portion 7B of the trap portion 7. The second heater 77 heats the trap portion 7. With this configuration, the reaction product accumulated on the trap portion 7 can be removed by heating of the trap portion 7 by the second heater 77. The temperature of heating of the trap portion 7 by the second heater 77 is, for example, 150° C. Such a heating temperature can be set as necessary according to, e.g., the raw material used for the process performed in the gas-discharging target device CH.

Figure 4:
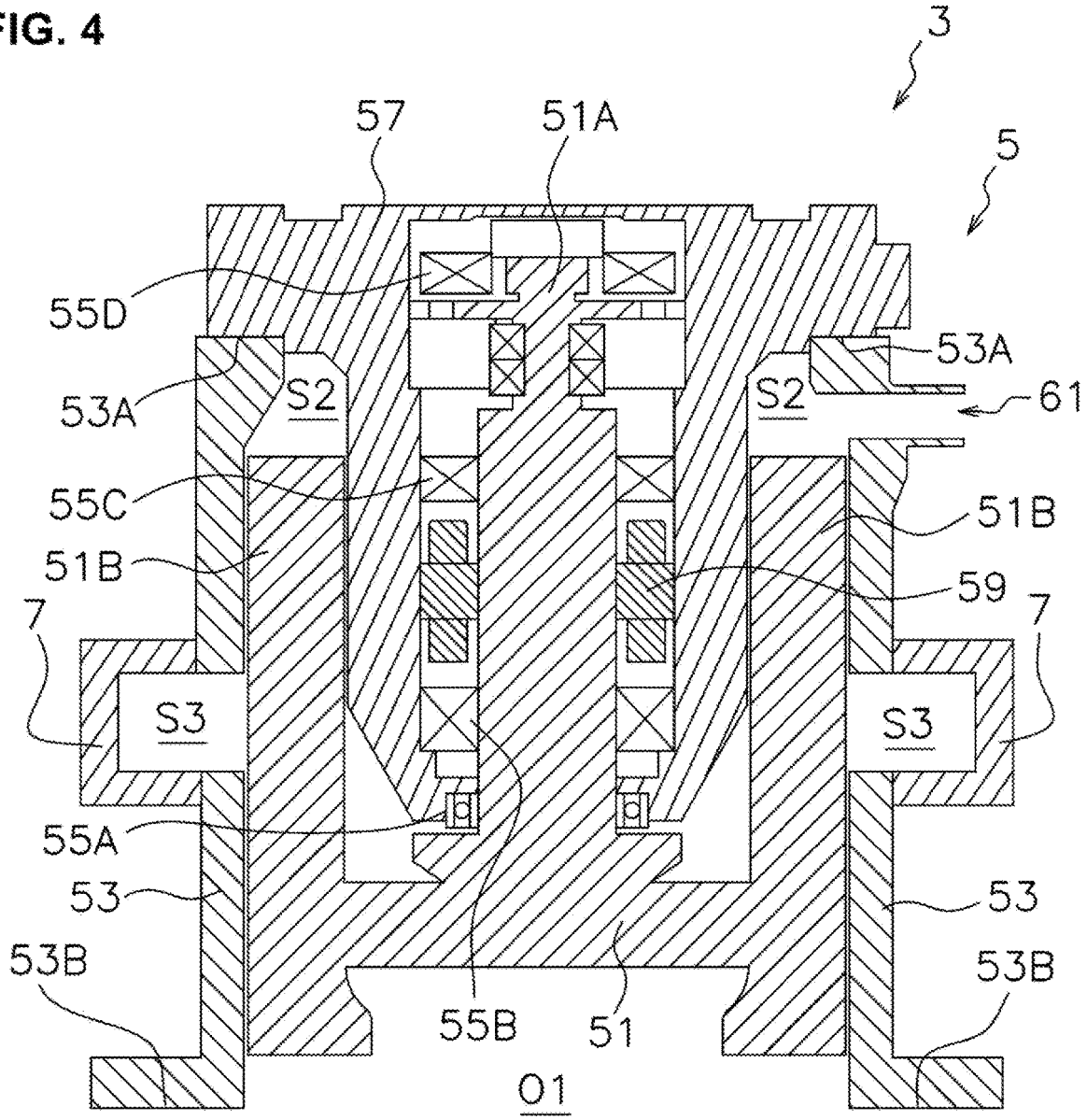
FIG. 4 is a sectional view of a second vacuum pump provided with a trap portion in the middle of a pump portion.

Note that the position of the trap portion 7 in the second vacuum pump 3 is not limited to that of the opening O1 of the pump portion 5. For example, as shown in FIG. 4, the trap portion 7 may be provided in the middle of the pump portion 5. Specifically, the trap portion 7 may be provided such that the third internal space S3 is connected to an opening provided at the second stator 53. FIG. 4 is a sectional view of the second vacuum pump 3 configured such that the trap portion 7 is provided in the middle of the pump portion 5. Note that in this variation, the opening O1 of the pump portion 5 is connected to the first exhaust port 19 of the first vacuum pump 1.

In the second vacuum pump 3 configured such that the trap portion 7 is provided in the middle of the pump portion 5, the pump portion 5 guides gas from the first exhaust port 19 of the first vacuum pump 1 to the opening O1. The gas guided to the opening O1 is, by suction by the pump portion 5, discharged through the second exhaust port 61 after having passed through a portion between the second rotor cylindrical portion 51B and the second stator 53. While passing through the portion between the second rotor cylindrical portion 51B and the second stator 53, the gas guided to the opening O1 is accumulated in the third internal space S3 of the trap portion 7. The reaction product is generated from the gas accumulated in the third internal space S3, and is accumulated on the trap portion 7.

4. Operation of Vacuuming Gas-Discharging Target Device

Hereinafter, the vacuuming operation of bringing the inside of the gas-discharging target device CH into the high vacuum state by means of the vacuum pump system 100 will be described. First, the gas-discharging target device CH is vacuumed to such a pressure that the first vacuum pump 1 is operable. Such vacuuming can be performed in such a manner that the third vacuum pump 9 is operated with the second valve V2 being opened and gas is sucked from the gas-discharging target device CH by the third vacuum pump 9. During such vacuuming, the on-off valve 2 and the first valve V1 are closed.

After the inside of the gas-discharging target device CH has reached such a pressure that the first vacuum pump 1 is operable, vacuuming by the first vacuum pump 1 is started. Specifically, after the second valve V2 has been closed and the first valve V1 has been opened, the first vacuum pump 1 and the second vacuum pump 3 are operated. Thereafter, the on-off valve 2 is opened, and accordingly, vacuuming by the first vacuum pump 1 is started. Note that in a case where the first vacuum pump 1 and the second vacuum pump 3 are constantly operated, vacuuming by the first vacuum pump 1 is started by opening the on-off valve 2 after the second valve V2 has been closed and the first valve V1 has been opened.

After the gas-discharging target device CH has been brought into the high vacuum state by the first vacuum pump 1, various processes are executed in the gas-discharging target device CH. For example, gas injected into the gas-discharging target device CH is used as a raw material to execute the process for generating a semiconductor material. Alternatively, gas injected into the gas-discharging target device CH is used as etching gas to execute the process for etching, e.g., a substrate.

The gas injected into the gas-discharging target device CH is discharged by the vacuum pump system 100. Specifically, the gas in the gas-discharging target device CH is first sucked by the first vacuum pump 1, and is discharged through the first exhaust port 19. The gas discharged through the first exhaust port 19 is, by suction by the pump portion 5 of the second vacuum pump 3, guided to the third internal space S3 through the first gas line L1. The gas guided to the third internal space S3 is cooled while staying in the third internal space S3. As a result, the reaction product is generated from the gas guided to the third internal space S3, and is accumulated on the trap portion 7. After having generated the reaction product, the gas guided to the third internal space S3 is discharged through the second exhaust port 61 by the pump portion 5, and is sucked by the third vacuum pump 9.

In the vacuum pump system 100, the third internal space S3 of the second vacuum pump 3 is connected to the first exhaust port 19 through the first gas line L1. Moreover, the first exhaust port 19 is connected to the inside of the first vacuum pump 1. Thus, the internal pressure of the first vacuum pump 1 is decreased by the pump portion 5 of the second vacuum pump 3. When the internal pressure of the first vacuum pump 1 decreases, the partial pressure of the gas as the raw material of the reaction product reaches lower than a saturated vapor pressure in the first vacuum pump 1, and therefore, generation and accumulation of the reaction product in the first vacuum pump 1 are reduced. With no reaction product accumulated inside, cleaning of the inside of the first vacuum pump 1 is not necessary. Moreover, since the gas is also sucked from the first exhaust port 19 and the first gas line L1 by the pump portion 5, generation of the reaction product in the first exhaust port 19 and the first gas line L1 is also reduced. As a result, the frequency of maintenance of the first vacuum pump 1 and the first gas line L1 can be decreased.

Since generation of the reaction product in the first exhaust port 19 and the first gas line L1 is reduced, the conductance of the first exhaust port 19 and the first gas line L1 is maintained high. As a result, the capacity of the pump portion 5 for sucking gas from the first exhaust port 19 is not degraded, and therefore, the back pressure of the first vacuum pump 1 can be maintained low. As a result, the capacity of the vacuum pump system 100 for discharging gas from the gas-discharging target device CH can be maintained high. Further, it is not necessary to increase the internal temperature of the first vacuum pump 1 for reducing generation of the reaction product, and therefore, the exhaust capacity of the first vacuum pump 1 is improved. Specifically, the amount of gas dischargeable by the first vacuum pump 1 can be increased. Moreover, the inside of the gas-discharging target device CH can be brought into a higher vacuum state as compared to a typical technique.

In the vacuum pump system 100, the reaction product is generated and accumulated on the trap portion 7 of the second vacuum pump 3, and after generation of the reaction product, the gas is discharged by the pump portion 5. Thus, the reaction product is less likely to be generated at the pump portion 5. As a result, the frequency of cleaning of the pump portion 5 can be decreased, and therefore, maintenance of the second vacuum pump 3 is facilitated. In a case where a great amount of reaction product is accumulated on the trap portion 7, the trap portion 7 is replaced or cleaned.

In the second vacuum pump 3 configured such that the trap portion 7 is provided at the large opening O1 of the second stator 53, even if a great amount of reaction product is accumulated on the trap portion 7, a conductance between the pump portion 5 and the third internal space S3 is not decreased, and the capacity of the pump portion 5 for sucking gas into the third internal space S3 is less likely to be degraded.

Note that in the vacuum pump system 100, not only both the first vacuum pump 1 and the second vacuum pump 3 can be operated to vacuum the inside of the gas-discharging target device CH, but also only the second vacuum pump 3 can be operated to vacuum the inside of the gas-discharging target device CH. The exhaust capacity of the second vacuum pump 3 is not so high as in the first vacuum pump 1, and for this reason, the inside of the gas-discharging target device CH is vacuumed only by the second vacuum pump 3 so that the gas-discharging target device CH can be vacuumed to a high pressure which cannot be achieved by the first vacuum pump 1. As a result, the types of processes executable by the single gas-discharging target device CH can be increased. For example, the single gas-discharging target device CH can execute a process (e.g., sputtering or etching) requiring a high vacuum and a process (e.g., CVD) requiring a low vacuum. Note that when the gas-discharging target device CH is vacuumed only by the second vacuum pump 3, generation of the reaction product in the first vacuum pump 1 can be reduced by, e.g., an increase in the internal temperature of the first vacuum pump 1.

5. Cleaning Operation with Plasma Generation Portion

Next, the operation of cleaning the vacuum pump system 100 and the like by means of the plasma generation portion 75 provided in the trap portion 7 of the second vacuum pump 3 will be described. Cleaning with the plasma generation portion 75 is performed in such a manner that the on-off valve 2, the first valve V1, and/or the second valve V2 are brought into an open state and the plasma is generated in the third internal space S3 by the plasma generation portion 75. In this manner, radicals generated by the plasma can remove, from the third internal space S3, the reaction product present up to a location that the radicals can reach.

Alternatively, cleaning may be executed in such a manner that the on-off valve 2 and the second valve V2 are brought into the open state, the first valve V1 is brought into a closed state, and the third vacuum pump 9 is operated to generate the plasma in the third internal space S3 by means of the plasma generation portion 75. In this case, the radicals generated by the plasma easily reach, from the third internal space S3, the first gas line L1, the inside of the first vacuum pump 1, the inside of the gas-discharging target device CH, the fourth gas line L4, the fifth gas line L5, and the third gas line L3. As a result, cleaning can be executed for a portion from the third internal space S3 to the first gas line L1, the inside of the first vacuum pump 1, the inside of the gas-discharging target device CH, the fourth gas line L4, the fifth gas line L5, and the third gas line L3.

Alternatively, cleaning may be executed in such a manner that the first valve V1 is brought into the open state, the on-off valve 2 and the second valve V2 are brought into the closed state, and the third vacuum pump 9 is operated to generate the plasma in the third internal space S3 by means of the plasma generation portion 75. In this case, the radicals generated by the plasma easily reach, from the third internal space S3, the second gas line L2 and the third gas line L3. As a result, cleaning can be executed for a portion from the third internal space S3 to the second gas line L2 and the third gas line L3.

In the vacuum pump system 100 according to the present embodiment as described above, the pump portion 5 of the second vacuum pump 3 sucks gas into the third internal space S3 of the trap portion 7 of the second vacuum pump 3 from the first exhaust port 19 of the first vacuum pump 1. With this configuration, the pressure of an exhaust path from the inside of the first vacuum pump 1 to the second vacuum pump 3 can be decreased. When the pressure of the exhaust path from the inside of the first vacuum pump 1 to the second vacuum pump 3 decreases, the partial pressure of gas as the raw material of the reaction product reaches lower than the saturated vapor pressure at such a location, and therefore, generation and accumulation of the reaction product in the exhaust path from the inside of the first vacuum pump 1 to the second vacuum pump 3 are reduced. As a result, the frequency of maintenance of the first vacuum pump 1 and a gas pipe (the first gas line L1) can be decreased. Moreover, since the reaction product is accumulated in the third internal space S3 of the trap portion 7 of the second vacuum pump 3, generation of the reaction product in the pump portion 5 can be reduced.

Since generation of the reaction product in the exhaust path from the first vacuum pump 1 to the second vacuum pump 3 is reduced, the conductance of such an exhaust path is maintained high. As a result, the capacity of the pump portion 5 for sucking gas from the first exhaust port 19 of the first vacuum pump 1 is not degraded, and therefore, the exhaust-side back pressure of the first vacuum pump 1 can be maintained low. Further, it is not necessary to increase the internal temperature of the first vacuum pump 1 for reducing generation of the reaction product. As a result, the exhaust performance of the vacuum pump system 100 can be maintained high. Further, since it is not necessary to increase the internal temperature of the first vacuum pump 1 for reducing generation of the reaction product, the exhaust capacity of the first vacuum pump 1 is improved.

One embodiment of the present invention has been described above, but the present invention is not limited to the above-described embodiment and various changes can be made without departing from the gist of the invention.

The second vacuum pump 3 is not necessarily incorporated into the vacuum pump system 100 in advance. That is, the second vacuum pump 3 can be also used as an independent vacuum pump. In this case, the second vacuum pump 3 can be incorporated into an existing system including the first vacuum pump 1 and the third vacuum pump 9.

In the second vacuum pump 3, a positional relationship between the pump portion 5 and the trap portion 7 is not necessarily such a positional relationship that the trap portion 7 is provided on the lower side of the pump portion 5 in the vertical direction as long as the reaction product accumulated on the trap portion 7 is less likely to enter the pump portion 5. For example, a positional relationship in which the pump portion 5 and the trap portion 7 are arranged in the horizontal direction may be employed.

The method for accumulating gas in the third internal space S3 of the second vacuum pump 3 is not limited to one in which the structure of the third internal space S3 is made such that gas is easily accumulated therein. For example, gas can be also accumulated in the third internal space S3 by rotation of the second rotor 51 of the pump portion 5 at a proper rotational speed.

The first vacuum pump 1 according to the above-described embodiment is the pump configured such that the turbo-molecular pump portion including the multiple stages of the rotor blades 13A and the multiple stages of the stator blades 15A and the screw groove pump portion including the rotor cylindrical portion 13B and the stator cylindrical portion 15B are integrated with each other. However, the screw groove pump portion may be omitted. That is, the first vacuum pump 1 may be a turbo-molecular pump. Alternatively, the turbo-molecular pump portion may be omitted. That is, the first vacuum pump 1 may be a screw groove pump.

Those skilled in the art understand that the above-described multiple exemplary embodiments are specific examples of the following aspects.

(First Aspect)

A vacuum pump system includes a first vacuum pump and a second vacuum pump connected to an exhaust port of the first vacuum pump. The second vacuum pump has a pump portion and a trap portion. The pump portion has a rotor. The trap portion is configured such that a reaction product generated from gas guided to an internal space from the exhaust port of the first vacuum pump by suction by the pump portion is accumulated thereon.

In the vacuum pump system according to the first aspect, the pump portion of the second vacuum pump sucks gas into the internal space of the trap portion of the second vacuum pump from the exhaust port of the first vacuum pump. With this configuration, the pressure of an exhaust path from the inside of the first vacuum pump to the second vacuum pump can be decreased, and therefore, generation of the reaction product in the first vacuum pump and the exhaust path from the first vacuum pump to the second vacuum pump is reduced. As a result, the frequency of maintenance of the first vacuum pump and a gas pipe can be decreased. Moreover, the reaction product is accumulated in the internal space of the trap portion of the second vacuum pump, and therefore, generation of the reaction product in the pump portion can be reduced.

Since generation of the reaction product in the exhaust path from the first vacuum pump to the second vacuum pump is reduced, the conductance of such an exhaust path is maintained high. As a result, the capacity of the pump portion for sucking gas from the exhaust port of the first vacuum pump is not degraded, and therefore, the exhaust-side back pressure of the first vacuum pump can be maintained low. Further, it is not necessary to increase the internal temperature of the first vacuum pump. As a result, the exhaust performance of the vacuum pump system can be maintained high. Further, the exhaust capacity of the first vacuum pump is improved.

(Second Aspect)

The vacuum pump system of the first aspect may further include a cooling portion. The cooling portion cools the trap portion. With this configuration, gas in the internal space of the trap portion is cooled so that the reaction product can be easily generated in the internal space.

(Third Aspect)

The trap portion may be arranged on the lower side of the pump portion in a vertical direction.

With this configuration, the reaction product accumulated on the trap portion is less likely to enter the pump portion.

(Fourth Aspect)

The vacuum pump system may further include a plasma generation portion. The plasma generation portion generates plasma in the internal space of the trap portion. With this configuration, cleaning for removing the reaction product generated in the vacuum pump system can be executed without, e.g., disassembly of the vacuum pump system.

(Fifth Aspect)

The vacuum pump system may further include a first heater. The first heater heats the pump portion. The pump portion is heated by the first heater so that accumulation of the reaction product on the pump portion can be reduced.

(Sixth Aspect)

The vacuum pump system may further include a second heater. The second heater heats the trap portion. With this configuration, the reaction product accumulated on the trap portion can be removed by heating of the trap portion by the second heater.

(Seventh Aspect)

A vacuum pump includes a pump portion and a trap portion. The pump portion includes a rotor and a stator housing the rotor. The trap portion has an internal space connected to an opening of the stator. The trap portion is configured such that a reaction product generated from gas guided to the internal space by suction by the pump portion is accumulated thereon. In the vacuum pump according to the seventh aspect, the reaction product is accumulated in the internal space of the trap portion, and after generation of the reaction product, gas is discharged by the pump portion. Thus, the reaction product is less likely to be generated at the pump portion. As a result, the frequency of cleaning of the pump portion can be decreased, and therefore, maintenance of the second vacuum pump is facilitated. Moreover, the trap portion is provided at the large opening of the stator. Thus, in a case where a great amount of reaction product is accumulated on the trap portion, a conductance between the pump portion and the internal space is not decreased, and the capacity of the pump portion for sucking gas into the internal space is less likely to be degraded.

What is claimed is:

1. A vacuum pump system comprising:

a first vacuum pump; and a second vacuum pump connected to an exhaust port of the first vacuum pump, wherein the second vacuum pump has a Holweck pump portion having a rotor and a stator, with either the rotor or the stator including a screw groove, and a trap portion configured such that a reaction product generated from gas guided to an internal space from the exhaust port by suction by the pump portion is accumulated thereon.

2. The vacuum pump system according to claim 1, further comprising:

a cooling portion configured to cool the trap portion.

3. The vacuum pump system according to claim 1, wherein the trap portion is arranged on a lower side of the Holweck pump portion in a vertical direction.

4. The vacuum pump system according to claim 1, further comprising:

a plasma generation portion configured to generate plasma in the internal space.

5. The vacuum pump system according to claim 1, further comprising:

a first heater configured to heat the Holweck pump portion.

6. The vacuum pump system according to claim 1, further comprising:

a second heater configured to heat the trap portion.

7. The vacuum pump system according to claim 1, the first vacuum pump includes a turbo-molecular pump.

8. A vacuum pump comprising:

a Holweck pump portion having a rotor and a stator, with either the rotor or the stator including a screw groove; and a trap portion configured such that a reaction product generated from gas guided to an internal space by suction by the Holweck pump portion is accumulated thereon.

* * * * *